US007549869B1

(12) United States Patent
Chiang et al.

(10) Patent No.: US 7,549,869 B1
(45) Date of Patent: Jun. 23, 2009

(54) CONNECTOR

(75) Inventors: Shu-Man Chiang, Taipei Hsien (TW); Mei-Chuan Yang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/137,922

(22) Filed: Jun. 12, 2008

(51) Int. Cl.
*H01R 12/00* (2006.01)

(52) U.S. Cl. ..... 439/65; 439/862; 439/916

(58) Field of Classification Search ..... 439/916, 439/65, 862
See application file for complete search history.

(56) References Cited

U.S. PATENT DOCUMENTS

| | | | | |
|---|---|---|---|---|
| 5,026,290 | A * | 6/1991 | Dery | 439/65 |
| 5,735,696 | A * | 4/1998 | Niitsu et al. | 439/65 |
| 5,885,090 | A * | 3/1999 | Comstock et al. | 439/65 |
| 6,077,130 | A * | 6/2000 | Hughes et al. | 439/862 |
| 6,155,844 | A * | 12/2000 | Semmeling et al. | 439/65 |
| 6,253,451 | B1 * | 7/2001 | Semmeling et al. | 29/842 |
| 6,302,727 | B1 * | 10/2001 | Fedorjaka | 439/500 |
| 6,863,540 | B2 * | 3/2005 | Spykerman | 439/66 |
| 6,875,049 | B2 * | 4/2005 | Kyowski et al. | 439/500 |
| 6,994,576 | B2 * | 2/2006 | Tanaka et al. | 439/188 |
| 7,029,287 | B2 * | 4/2006 | Matsunaga et al. | 439/65 |
| 7,063,540 | B2 * | 6/2006 | Sun et al. | 439/65 |
| 7,258,571 | B1 * | 8/2007 | Chen | 439/500 |
| 7,287,986 | B2 * | 10/2007 | Ho | 439/65 |
| 7,303,401 | B2 * | 12/2007 | Schell et al. | 439/65 |
| 7,390,229 | B2 * | 6/2008 | Huang et al. | 439/862 |
| 7,435,098 | B2 * | 10/2008 | Yi et al. | 439/65 |
| 2004/0029408 | A1 * | 2/2004 | Brown, III | 439/65 |
| 2005/0079742 | A1 * | 4/2005 | Shimizu et al. | 439/65 |
| 2005/0221632 | A1 * | 10/2005 | Sun et al. | 439/65 |
| 2007/0053543 | A1 * | 3/2007 | Lee | 381/381 |
| 2008/0119138 | A1 * | 5/2008 | Kim et al. | 455/41.2 |
| 2008/0159580 | A1 * | 7/2008 | Cheng et al. | 381/374 |
| 2008/0268914 | A1 * | 10/2008 | Gwee | 455/570 |
| 2008/0310656 | A1 * | 12/2008 | Tsai | 381/151 |

* cited by examiner

*Primary Examiner*—Ross N Gushi
(74) *Attorney, Agent, or Firm*—Muncy, Geissler, Olds & Lowe, PLLC

(57) ABSTRACT

A connector has an insulating housing. The insulating housing has a mating body and a receiving body connected with the mating body. The mating body has a mating surface which defines at least one cavity. The receiving body defines a top surface, a bottom surface and a side surface. A first terminal has a first contacting portion positioned on the top surface and adapted for being connected with a first printed circuit board, and a first connecting portion protruding into the corresponding cavity. A second terminal has a second contacting portion also positioned on the top surface and a second connecting portion extending out of the side surface and adapted for being connected to a second printed circuit board. A third terminal has a third contacting portion also positioned on the top surface and an antenna-connecting portion extending out of the bottom surface for connecting an antenna device.

3 Claims, 4 Drawing Sheets

CONNECTOR

BACKGROUND OF THE INVENTION

1. Field of the Invention

The present invention relates to a connector, and more particularly to a connector mainly applied in bluetooth earphone.

2. The Related Art

A bluetooth earphone is a wireless earphone manufactured via adapting the bluetooth technology for short-distance signal transmission. The bluetooth earphone offers the advantages of excellent compatibility, high quality and attractive appearance. As a result, the bluetooth earphone has been widely used in various electronic devices, such as mobile phone, PDA and so on, and attracts many people who want to release their hands or are in pursuit of the fashion. However, with recent improvement in economic status and resulting interest in well-being, the requirement for compact size and high portability of the bluetooth earphone increases gradually.

Generally, the conventional bluetooth earphone has a first printed circuit board (herein referred as to PCB), a second PCB, an antenna connector, a charge connector and a board-to-board connector. The antenna connector is adapted to connect the first PCB and an antenna device for transmitting the electrical signal therebetween. Thus, the bluetooth earphone is capable of receiving and outputting the audio signal. The charge connector is connected to the first PCB for charging the bluetooth earphone. And the board-to-board connector is used to couple the first PCB and the second PCB for electrically transferring electrical signal between the first PCB and the second PCB.

As described above, the conventional bluetooth earphone has three independent connectors to connect with the first PCB, the second PCB, the antenna device and the charge plug, which not only adds the weight and the volume of the conventional bluetooth earphone, but also augments the complexity of manufacture and assembly of the conventional bluetooth earphone.

SUMMARY OF THE INVENTION

Accordingly, an object of the present invention is to provide a connector which is capable of synchronously connecting with a first PCB, a second PCB, an antenna device and a charge plug.

The connector has an insulating housing. The insulating housing has a mating body and a receiving body connected with the mating body. The mating body has a mating surface which defines at least one cavity. The receiving body defines a top surface, a bottom surface and a side surface. A first terminal has a first contacting portion positioned on the top surface and adapted for being connected with a first printed circuit board, and a first connecting portion protruding into the corresponding cavity. A second terminal has a second contacting portion also positioned on the top surface and a second connecting portion extending out of the side surface and adapted for being connected to a second printed circuit board. A third terminal has a third contacting portion also positioned on the top surface and an antenna-connecting portion extending out of the bottom surface for connecting an antenna device.

As described above, the insulating housing of the connector is capable of receiving the first terminal, the second terminal and the third terminal at the same time. The first terminal is adapted to connect with the first PCB and the charge plug for supplying electricity. The second terminal is adapted to connect with the first PCB and the second PCB, which makes the first PCB be connected with the second PCB electrically. The third terminal is adapted to connect with the first PCB and the antenna device for transmitting the electrical signal therebetween. That is, the connector collects all the performances of the antenna connector, the charge connector and the board-to-board connector. So, compared to the conventional connector used in the bluetooth earphone, the bluetooth earphone using the connector not only reduces the weight and volume, but also reduces the complexity of the manufacture and assembly.

BRIEF DESCRIPTION OF THE DRAWINGS

The present invention will be apparent to those skilled in the art by reading the following description when taken in conjunction with the accompanying drawings, in which.

DETAILED DESCRIPTION OF THE PREFERRED EMBODIMENTS

Figure 1:
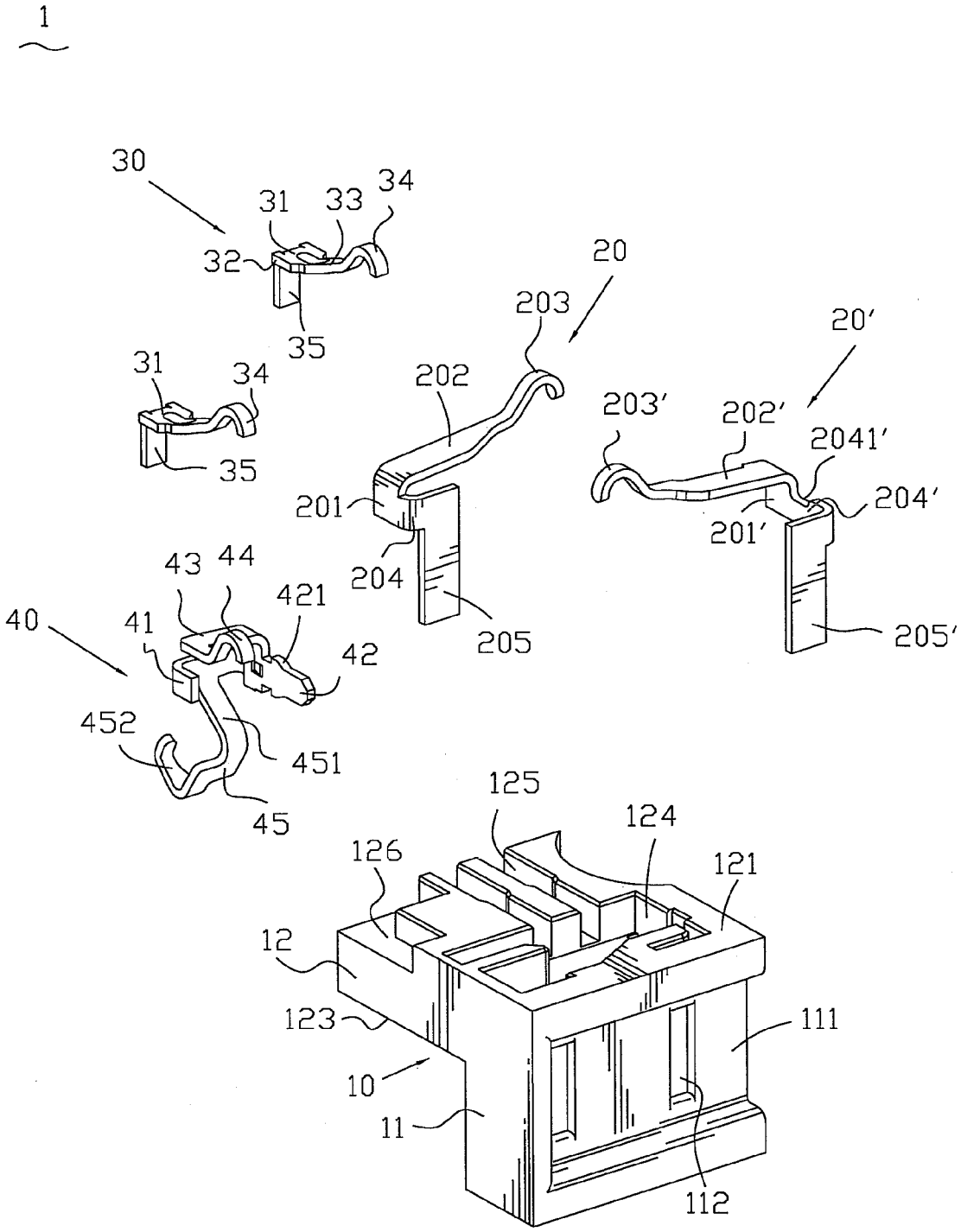
FIG. 1 is an exploded, perspective view of a connector in accordance with a first embodiment of the present invention.
Figure 2:
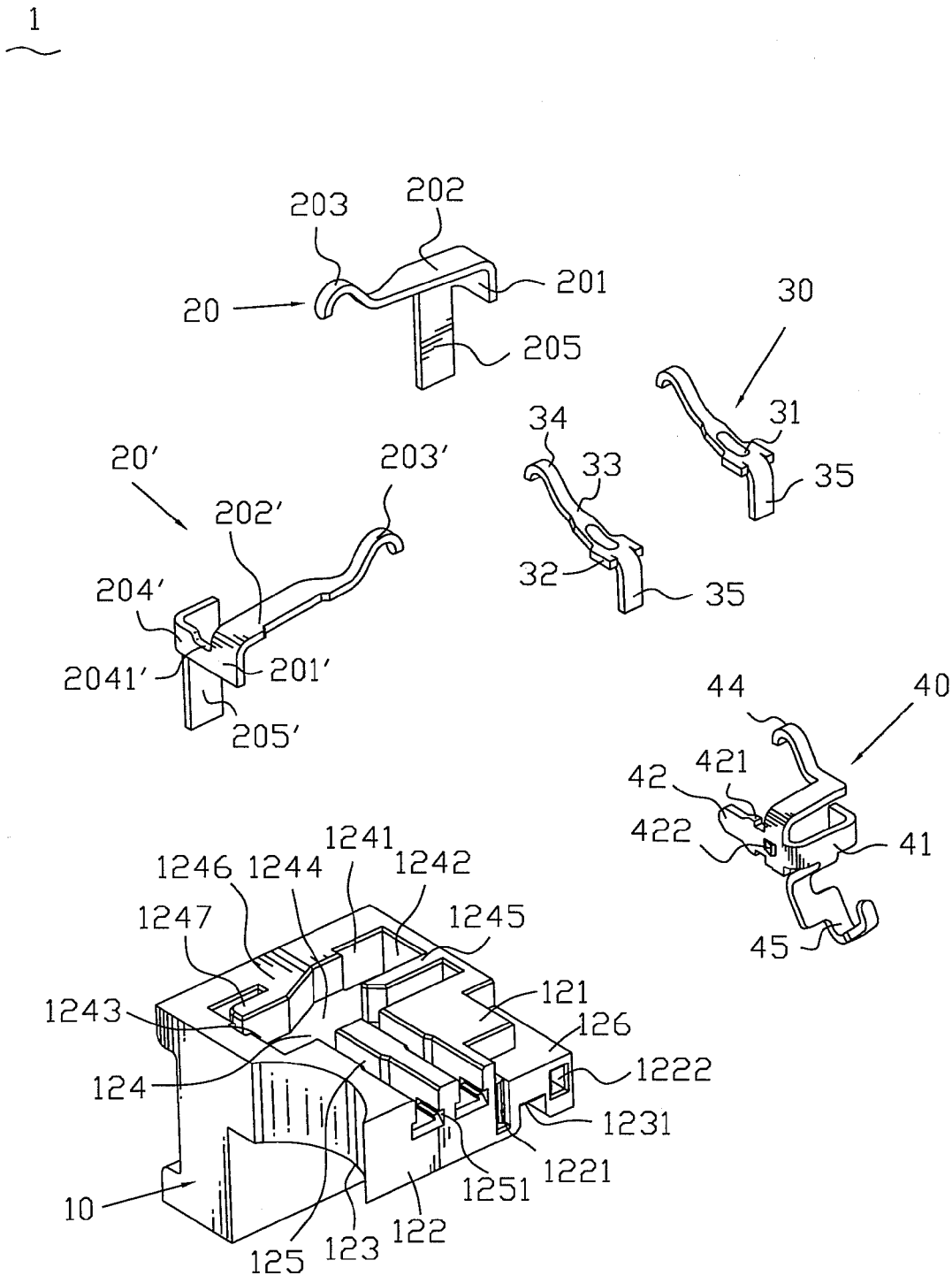
FIG. 2 is an exploded, perspective view of the connector shown in FIG. 1 while seen from another view.
Figure 3:
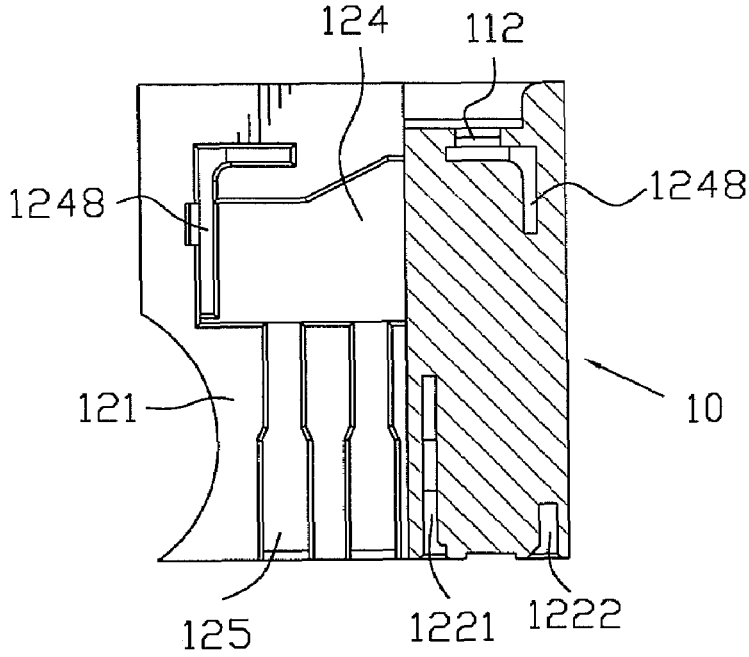
FIG. 3 is a partial cross-sectional view of an insulating housing of the connector shown in FIG. 2 seen from the top and the front view.

With reference to FIG. 1, FIG. 2 and FIG. 3, a connector 1 includes an insulating housing 10, two first terminals 20, 20', a second terminal 30 and a third terminal 40 all of which are assembled in the insulating housing 10.

The insulating housing 10 has a mating body 11 and a receiving body 12 extending outwards perpendicularly from an upper portion of the mating body 11. The mating body 11 defines a mating surface 111 thereon. The mating surface 111 in turn defines two cavities 112 therein for receiving terminals of a charge plug (not shown). The receiving body 12 defines a top surface 121, a side surface 122 and a bottom surface 123. The top surface 121 defines a first terminal recess 124. The first terminal recess 124 is approximately of rectangle shape. The first terminal recess 124 defines a first sidewall 1241 near the mating surface 111, a second sidewall 1242 and a third sidewall 1243 respectively contiguous to the first sidewall 1241, and a bottom 1244. A first restricting wall 1245 protrudes from the second sidewall 1242 at central portion thereof toward the third sidewall 1243. A projection 1246 is protruded somewhat inwardly from the first sidewall 1241 at the middle thereof. A free end of the projection 1246 bends a distance toward the third sidewall 1243 to form a second restricting wall 1247. The second restricting wall 1247 approximately parallels to the first restricting wall 1245 and is spaced apart from the first sidewall 1241 and the third sidewall 1243 a short distance. The bottom 1244 has a slot 1248 formed along a bottom of the third sidewall 1243, the first sidewall 1241, and the second sidewall 1242 between the first sidewall 1241 and the first restricting wall 1245. The slot 1248 communicates with the cavities 112 of the mating body 11.

The top surface 121 of the receiving body 12 defines a plurality of second terminal recesses 125 perpendicular to the first terminal recess 124. One end of the second terminal recess 125 communicates with the first terminal recess 124. The other end of the second terminal recess 125 extends to the side surface 122. The second terminal recess 125 defines a first recess 1251 passing through the side surface 122 and formed at each of two bottom sidewalls thereof.

The top surface 121 of the receiving body 12 defines a third terminal recess 126. The third terminal recess 126 is located at a corner of the receiving body 12 near the second sidewall 1242 of the first terminal recess 124 and passes through the side surface 122 and an end of the receiving body 12 to show an L-shaped. The side surface 122 has a second recess 1221 and a third recess 1222 parallel to the second recess 1221 near the third terminal recess 126. The second recess 1221 passes through a bottom of the third terminal recess 126 and is longer than the third recess 1222 longitudinally. The bottom surface 123 has a receiving recess 1231 located between the second recess 1221 and the third recess 1222 and passing through the side surface 122.

Please referring to FIG. 1 and FIG. 2, the first terminal 20 received in the first terminal recess 124 has a first fixed portion 201. The first fixed portion 201 is an oblong shape, an end of which bends and extends to form a first connective portion 202. A free end of the first connective portion 202 is curved to form a first contacting portion 203 which may be of arc shape. A side of the first fixed portion 201 extends outward to form a linking portion 204. A free end of the linking portion 204 bends toward the first connective portion 202 and extends downward to form a first connecting portion 205. The first connecting portion 205 is of rectangle shape. The first terminal 20' is substantially the same as the first terminal 20 in construction except for the linking portion 204'. The linking portion 204' extends outward from a side of the first fixed portion 201' opposite to the linking portion 204. The linking portion 204' is longer than the linking portion 204 and has an opening 2041' formed on the top side thereof.

The second terminal 30 received in the second recess 125 has a second fixed portion 31. The second fixed portion 31 has a fixed piece 32 formed at each of two sides thereof. One end of the second fixed portion 31 extends to form a second connective portion 33. A free end of the second connective portion 33 is curved to form a second contacting portion 34. The second contacting portion 34 is of arc shape. The other end of the second fixed portion 31 bends downwardly to form a second connecting portion 35. The second connecting portion 35 is of oblong-board shape.

The third terminal 40 received in the third recess 126 has a third fixed portion 41. The third fixed portion 41 is approximately U-shaped. One end of the third fixed portion 41 extends outward to form an insertion portion 42. The insertion portion 42 has a lump 421 formed at each of two sides thereof and a bump 422 formed at the outer surface thereof. A top side of the third fixed portion 41 near the insertion portion 42 bends and extends to form a third connective portion 43. A side of the third connective portion 43 extends acclivitously toward the insertion portion 42 and bends downward to form a third contacting portion 44 of arc shape. A bottom side of the third fixed portion 41 extends downward from the approximate middle thereof to form an antenna-connecting portion 45. The antenna-connecting portion 45 has a bending portion 451 inclining toward the insertion portion 42, while a free end of the bending portion 451 extends oppositely and bends upward to form an antenna connection 452 of hook shape.

Figure 4:
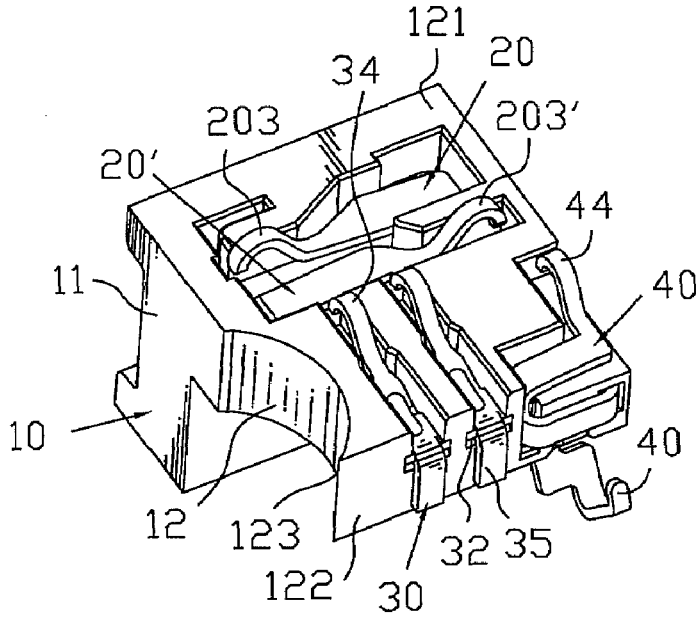
FIG. 4 is an assembled view of the connector shown in FIG. 2.
Figure 5:
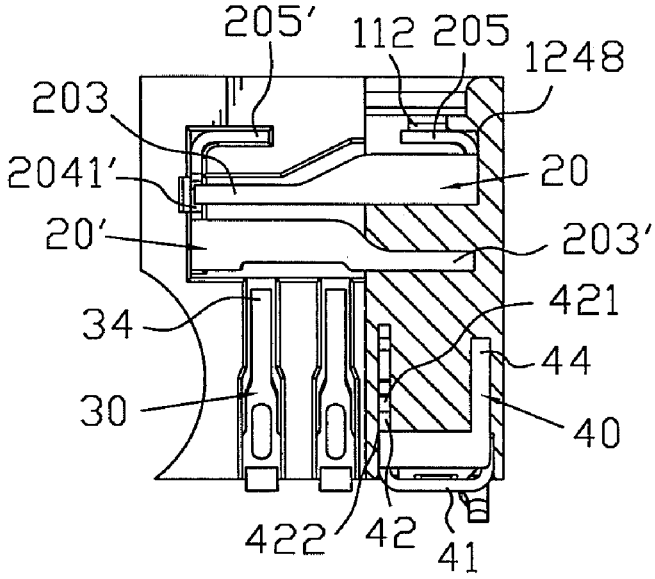
FIG. 5 is a partial cross-sectional, assembled view of the connector shown in FIG. 2 seen from the top and the front view.

Please referring to FIG. 2, FIG. 4 and FIG. 5, in assembly, the first terminals 20, 20', the second terminal 30 and the third terminal 40 are respectively received in the first terminal recess 124, the second terminal recess 125 and the third terminal recess 126. The first contacting portion 203, 203', the second contacting portion 34 and the third contacting portion 44 are disposed above the top surface 121 of the receiving body 12 for connecting to a first printed circuit board (not shown). The opening 2041' is adapted to prevent the first terminal 20 from being connected with the first terminal 20'. The first fixed portion 201, 201' and the linking portion 204, 204' are all inserted into the slot 1248 for fixing the first terminals 20, 20' to the first terminal recess 124. Thus the first fixed portion 20 is restricted between the first sidewall 1241, the second sidewall 1242, the projection 1246 and the first restricting wall 1245, the first fixed portion 20' is restricted between the first sidewall 1241, the third sidewall 1243 and the second restricting wall 1245. The first connecting portions 205, 205' pass through the slot 1248 to extend into the corresponding cavities 112 for connecting with terminals of the charge plug (not shown). The fixed pieces 32 come into the first recesses 1251 for fixing the second fixed portion 31 to the second terminal recess 125, and the second connecting portion 35 engages the side surface 122 for being soldered on a second PCB (not shown). The insertion portion 42 and the other free end of the third fixed portion 41 respectively extend into the second recess 1221 and the third recess 1222, the lumps 421 abut the sides of the second recess 1221 and the bump 422 is against one side of the third terminal recess 126, thus the third fixed portion 41 firmly encloses the side surface 122 between the second recess 1261 and the third recess 1262 so that the third terminal 40 is fixed to the receiving body 12. The bending portion 451 is received in the receiving recess 1231 and the antenna connection 452 extends beyond the side surface 122 for connecting with an antenna device.

As described above, the insulating housing 10 of the connector 1 is capable of receiving the first terminals 20, 20', the second terminal 30 and the third terminal 40. The first terminals 20, 20' may be connected with the first PCB and the charge plug for supplying electricity. The second terminal 30 connects with the first PCB and the second PCB, which makes the first PCB connect with the second PCB electrically. The third terminal 40 connects with the first PCB and an antenna device for transmitting the electrical signal therebetween. That is, the connector 1 itself incorporates all the performances of the antenna connector, the charge connector and the board-to-board connector. So, compared to the conventional connector used in the bluetooth earphone, the bluetooth earphone using the connector 1 not only reduces the weight and volume, but also reduces the complexity of the manufacture and assembly.

Figure 6:
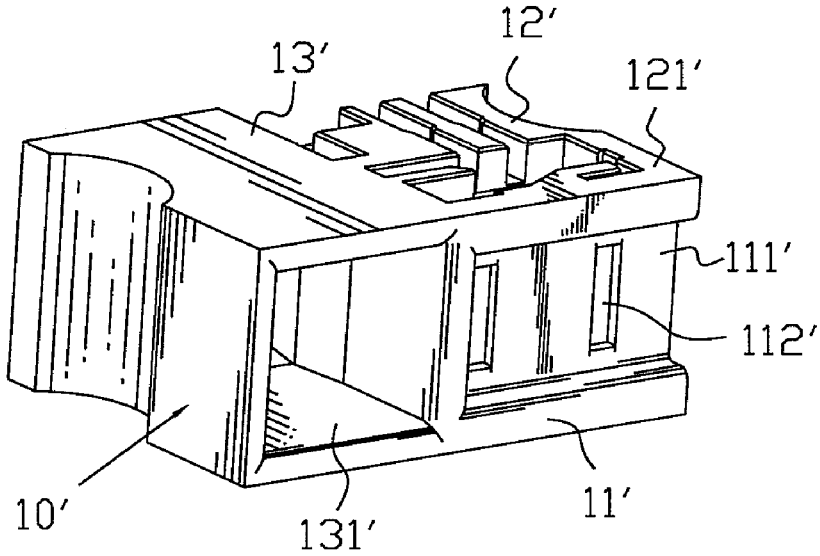
FIG. 6 is a perspective view of an insulating housing of a connector in accordance with a second embodiment of the present invention.

Please referring to FIG. 6, a connector 1' in accordance with a second embodiment of the present invention is illustrated. In comparison with the first embodiment of the present invention, the structure of the connector 1' is the same as that of the connector 1 except for the insulating housing 10'. The insulating housing 10' is somewhat different from the insulating housing 10 of the first embodiment in that the mating body 11' has a side extending outward to form an insertion body 13'. The insertion body 13' has a hole 131' parallel to the receiving body 12' and completely passing through the insertion body 13'. When terminals of a charge plug are inserted into the cavities 122', the hole 131' of the insertion body 13' is used to receive the fixed component of the charge plug for guaranteeing the terminals of the charge plug be connected to the first terminals 20, 20' steadily.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector capable of being mounted to a bluetooth earphone for connecting a first and second printed circuit board and an antenna device, comprising:

an insulating housing having a mating body and a receiving body connected with the mating body, the mating body having a mating surface which defines at least one cavity, the receiving body defining a top surface, a bottom surface and a side surface;

at least one first terminal having a first contacting portion positioned on the top surface of the receiving body and adapted for being connected with the first printed circuit board, and a first connecting portion protruding into the corresponding cavity of the mating body;

at least one second terminal having a second contacting portion also positioned on the top surface of the receiving body, and a second connecting portion extending out of the side surface of the receiving body and adapted for being connected to the second printed circuit board; and a third terminal having a third contacting portion also positioned on the top surface of the receiving body, and an antenna-connecting portion extending out of the bottom surface of the receiving body for connecting the antenna device.

2. The connector as claimed in claim 1, wherein the receiving body defines at least one first terminal recess passing through the top surface thereof, the first terminal recess has a slot formed at a bottom thereof and communicating with the cavity of the mating body, a fixed portion of the first terminal is received in the first terminal recess, and the first connecting portion passes through the slot to protrude into the cavity.

3. The connector as claimed in claim 2, wherein the mating body defines two cavities for receiving the first connecting portions of the first terminals therein, the first terminal recess for receiving the first terminal therein defines a first sidewall near the mating surface of the mating body, a second sidewall and a third sidewall respectively are connected to the first sidewall, the first sidewall protrudes slightly inwardly to form a projection which is distanced from the second sidewall and the third sidewall respectively, a first restricting wall is connected to the second sidewall and spaced away from the first sidewall, a second restricting wall is connected to the projection and spaced away from the first sidewall and the third wall, one of the fixed portions is restricted between the first sidewall, the second sidewall, the projection and the first restricting wall, while the other fixed portion is restricted between the first sidewall, the third sidewall and the second restricting wall.

* * * * *